US005339502A

United States Patent [19]

Grossenbacher et al.

[11] Patent Number: 5,339,502

[45] Date of Patent: Aug. 23, 1994

[54] METHOD AND APPARATUS FOR PLUG LOOSENING AFTER TEXTURING

[76] Inventors: Peter Grossenbacher, Tosstalstrasse 99, CH-8400 Winterthur; Werner Nabulon, Schneihalde 116, CH-8455 Rudlingen, both of Switzerland

[21] Appl. No.: 800,637

[22] Filed: Nov. 27, 1991

[30] Foreign Application Priority Data

Nov. 29, 1990 [CH] Switzerland ..... 03775/90

[51] Int. Cl.[5] ..... D02G 1/20; D02G 1/00

[52] U.S. Cl. ..... 28/221; 28/250

[58] Field of Search ..... 28/250, 251, 256, 258, 28/262, 263, 255, 217, 219, 220, 221, 247, 248, 249, 254, 257

[56] References Cited

U.S. PATENT DOCUMENTS

| | | | |
|---|---|---|---|
| 3,430,295 | 3/1969 | Dixon | 28/248 |
| 3,861,133 | 1/1975 | Frankfort et al. | 28/257 X |
| 3,885,278 | 5/1975 | Whitaker | 28/257 X |
| 4,019,228 | 4/1977 | Ozawa et al. | 28/221 |
| 4,027,466 | 6/1977 | Brehm | 28/217 X |
| 4,268,940 | 5/1981 | Kuroda et al. | 28/221 X |
| 4,309,801 | 1/1982 | Feffer | 28/221 X |
| 4,319,388 | 3/1982 | Champuneria | 28/258 |
| 5,088,168 | 2/1992 | Berger et al. | 28/263 X |

FOREIGN PATENT DOCUMENTS

| | | | |
|---|---|---|---|
| 4014639 | 11/1990 | Fed. Rep. of Germany . | |
| 0007049 | 2/1985 | Japan | 28/217 |
| 0618561 | 8/1980 | Switzerland . | |
| 2199853 | 7/1988 | United Kingdom | 28/250 |

*Primary Examiner*—Clifford D. Crowder
*Assistant Examiner*—Larry D. Worrell
*Attorney, Agent, or Firm*—Francis C. Hand

[57] ABSTRACT

A textured yarn is directed through a path in which the textured yarn plug forms a loop in which the direction of the yarn plug is changed and the speed of the yarn plug is increased via a draw-off bobbin. The yarn plug within the loop is loosened and the resulting yarn is stretched to form a yarn which can be wound up. The deflection loop in which the yarn plug is loosened is stable depending upon an appropriate choice of speeds between the speed at which the plug is guided into the loop and the speed at which the yarn is drawn from the loop. The deflection loop need not be supported by any mechanical devices.

21 Claims, 4 Drawing Sheets

Figure 1:
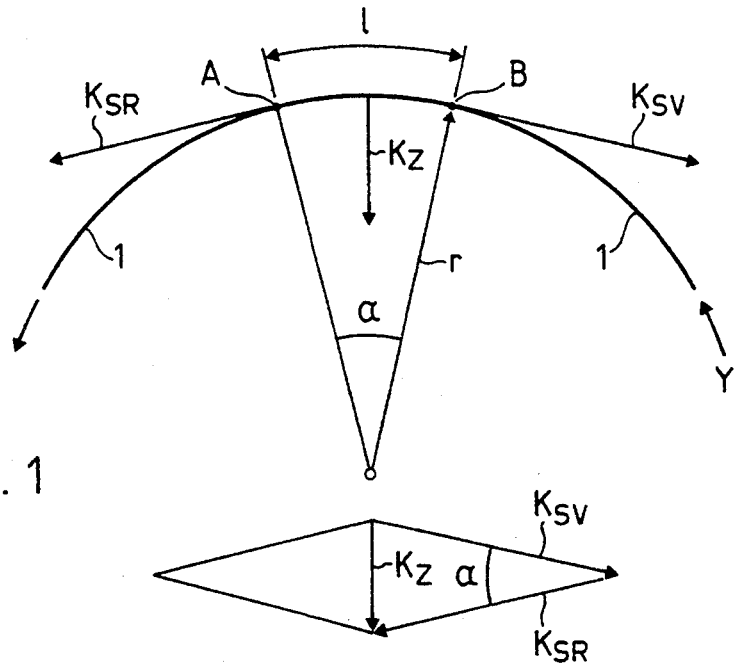

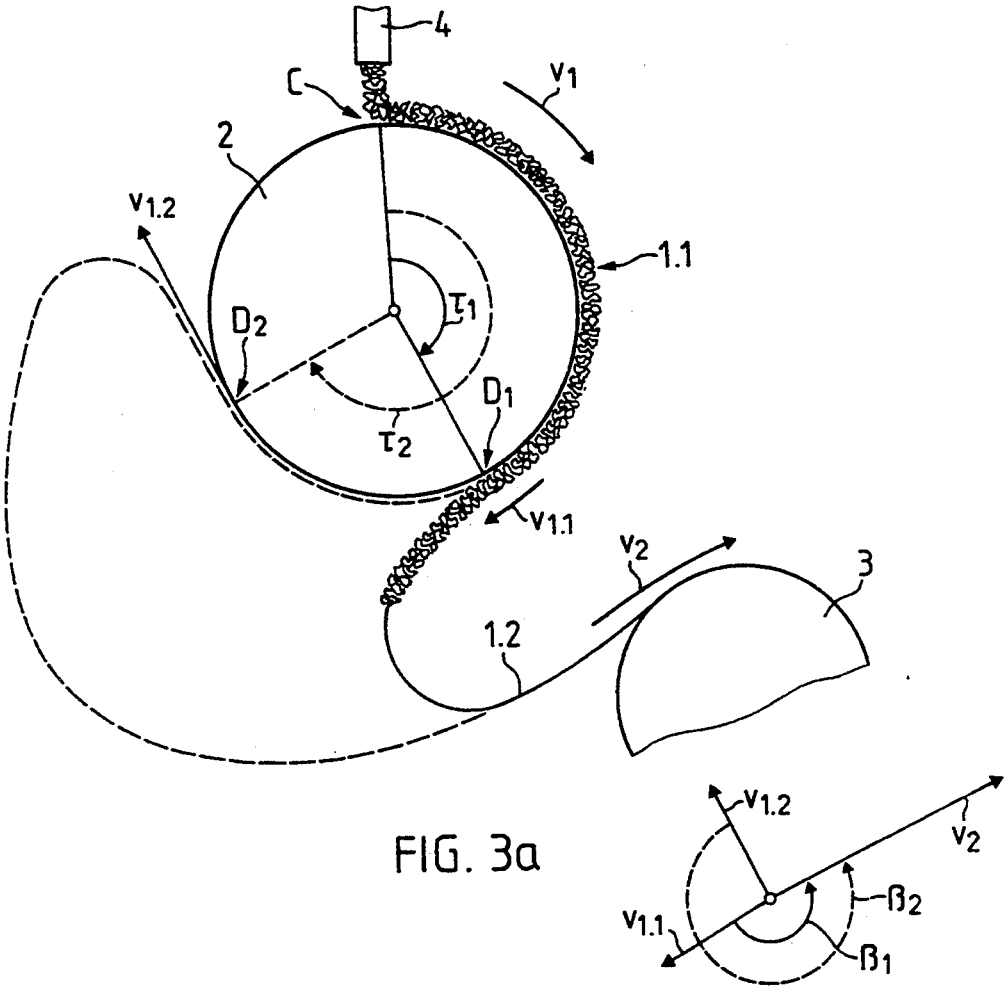
FIG. 3a
FIG. 3b
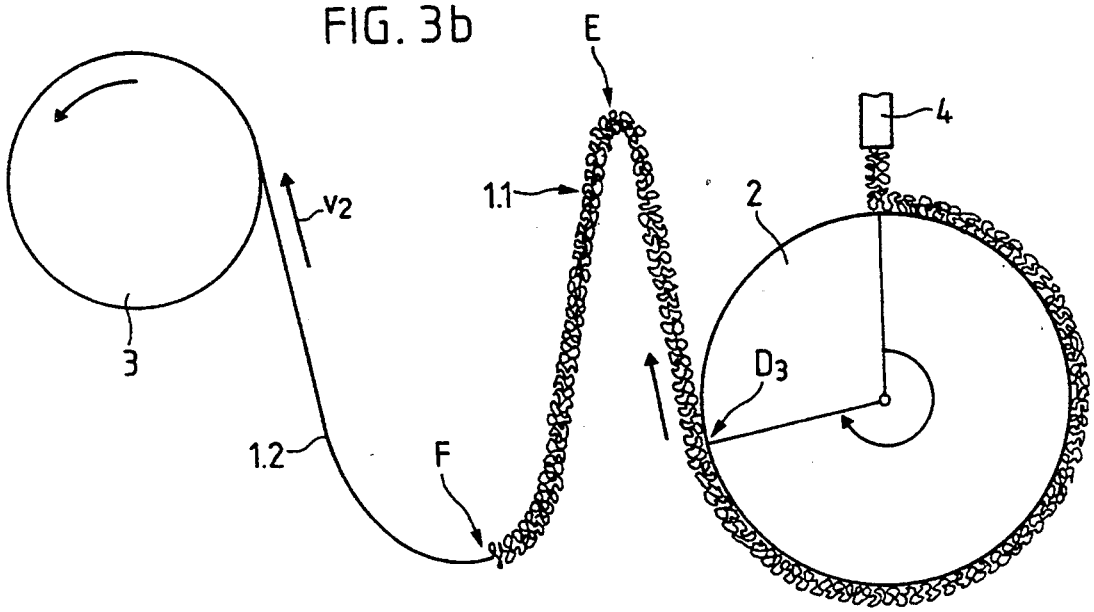

METHOD AND APPARATUS FOR PLUG LOOSENING AFTER TEXTURING

This invention relates to a method and apparatus for plug loosening after texturing. More particularly, this invention relates to a method and apparatus for loosening and stretching a yarn plug after texturing.

As is known, thermoplastic yarns which generally comprise several fibrils usually undergo a heat treatment and are driven through texturing nozzles or compressed in stuffing boxes in order to obtain a texturing of the yarns. Generally speaking, a still relatively hot, mechanically relatively stable yarn plug is obtained from the outlet of a texturing nozzle or the stuffing box. Accordingly, the yarn plug is usually cooled and then loosened before the textured (crimped) yarn can be wound or spooled up.

According to the prior art, the yarn plug from the texturing process is usually cooled, e.g. during an upward movement in a vertical tube. In the upper part of the tube, the yarn is accelerated by a draw-off device which is operated at a constant speed (draw-off speed), so that the plug loosens to form a more or less crimped yarn. This yarn is guided by means of a mechanical brake, e.g. a plurality of brake rods and is then wound up. The mechanical brake brings about a constant thread tension during winding up and prevents any thread tension rise in the cooling tube which would lead to a premature, uncontrolled plug loosening. The measurement of the height of the plug in the cooling tube or the measurement of its speed, both of which are dependent on the texturing conditions, can be used for regulating the latter. Such a method and apparatus are e.g. described in European patent 21 573.

Another method for loosening a yarn plug after texturing a thermoplastic yarn has the plug guided from the texturing nozzle to a screening drum or a perforated roller which rotates at a constant speed. In either case, the yarn plug is held and simultaneously cooled by air sucked into the drum or roller. While still on the drum, the yarn is accelerated and in this way the plug is loosened. The yarn is drawn by means of a mechanical brake from the screening drum and is wound up. Plug length fluctuations caused by differences in the texturing conditions are prevented by the constant drum speed. Plug length fluctuations caused by the draw-off process are automatically adjusted by automatically varying the friction of the drawn-off yarn on the drum. A corresponding method and apparatus are e.g. described in Swiss patent 618 561.

In both these methods, the plug is brought in two stages into a yarn which can be wound up. First, the plug is loosened to form a varyingly crimped yarn aligned in one main direction, which takes place between the end portion of the plug and the mechanical brake. Between the mechanical brake and the draw-off bobbin, the yarn is brought to the desired thread tension, so that in the wound up state the yarn has the desired, effective or possibly only latent crimping.

In both stages of the stretching process, forces must act on the yarn, mainly accelerative forces in the yarn movement direction and by which the yarn is accelerated against the draw-off bobbin, as well as tensile forces which are of equal magnitude in both yarn directions and which stretch the yarn or loosen the plug. The accelerative and tensile forces in the yarn movement direction are applied by the draw-off bobbin. The tensile force in the opposite direction is, in the second stage, (stretching the crimped yarn) the brake pressure of the mechanical brake caused by the mechanical friction of the yarn on the brake members. The same force in the first stage (plug loosening) is, for the first-described method, the weight and the resistance of the plug in the tube and, for the second described method, the brake pressure caused by the friction of the plug and the drawn-off yarn on the screening drum. The division into two stages of the method by the use of the mechanical brake is necessary, because the plug loosening only takes place in an orderly, controlled manner when minimum tensile forces come into effect, but these are not sufficient to stretch the yarn to the desired extent.

However, it has been found that the use of mechanical yarn brakes on a crimped yarn with the presently required yarn speeds of approximately 4000 meters/minute (m/min) is not of an optimum nature, because the mechanical yarn brakes lead to a reduction in the yarn quality as a result of an increased number of fibril breaks.

Accordingly, it is an object of the invention to provide a technique of straightening a yarn plug of textured thermoplastic yarn which does not rely upon mechanical friction on the yarn plug.

It is another object of the invention to be able to wind up a yarn with intact fibrils after texturing, loosening and stretching of the yarn.

It is another object of the invention to successively increase the yarn tension between the end portion of a yarn plug and a draw-off bobbin so that the yarn plug can be loosened with limited yarn tension and wound up with increased yarn tension.

It is another object of the invention to provide a self-regulating method for straightening a yarn plug which compensates not only for fluctuations in the plug characteristics caused by fluctuations in texturing conditions but also those caused by fluctuations of the yarn being textured.

Briefly, the invention provides a method and apparatus for straightening a textured thermoplastic yarn.

In accordance with the method, a textured thermoplastic yarn plug is moved in a first direction at a first speed and thereafter the direction of movement of the yarn is changed into a second direction while the speed of the yarn is increased to a second speed which is sufficient to loosen the yarn plug while stretching the yarn.

One apparatus for employing the method includes a texturing means for texturing a moving thermoplastic yarn into a textured yarn plug, a cooling means for receiving and cooling the yarn plug with the yarn plug moving in a first direction and at a first speed and a draw-off means for receiving the cooled yarn from the cooling means. This draw-off means is also disposed relative to the cooling means in order to change the direction of movement of the yarn into a second direction while increasing the speed of the yarn to a speed sufficient to loosen the yarn plug while stretching the yarn therebetween.

In one embodiment, the cooling means may be in the form of a perforated drum which is disposed below the texturing means for receiving the textured plug on a periphery of the drum under a suction force within the drum.

In another embodiment, the cooling means may be in the form of a ventilated housing having an inlet for receiving a downwardly directed yarn plug from the texturing means and an outlet for directing a stretched yarn to the draw-off means.

The basic principle of the method is that, for creating tensile force necessary for loosening the plug and stretching the yarn, the plug and/or the yarn is freely deflected instead of being mechanically braked as described for the state of the art. The tensile force resulting from the centrifugal force caused by the deflection can, in accordance with the invention be reinforced by corresponding utilization of gravity as well as aerodynamic or hydrodynamic frictional forces. Both the deflecting forces and the dynamic frictional forces can be successively increased between the end portion of the yarn plug and the draw-off bobbin. In this case, there is no need to divide the method into a plug loosening stage and a yarn stretching stage.

Figure 2:
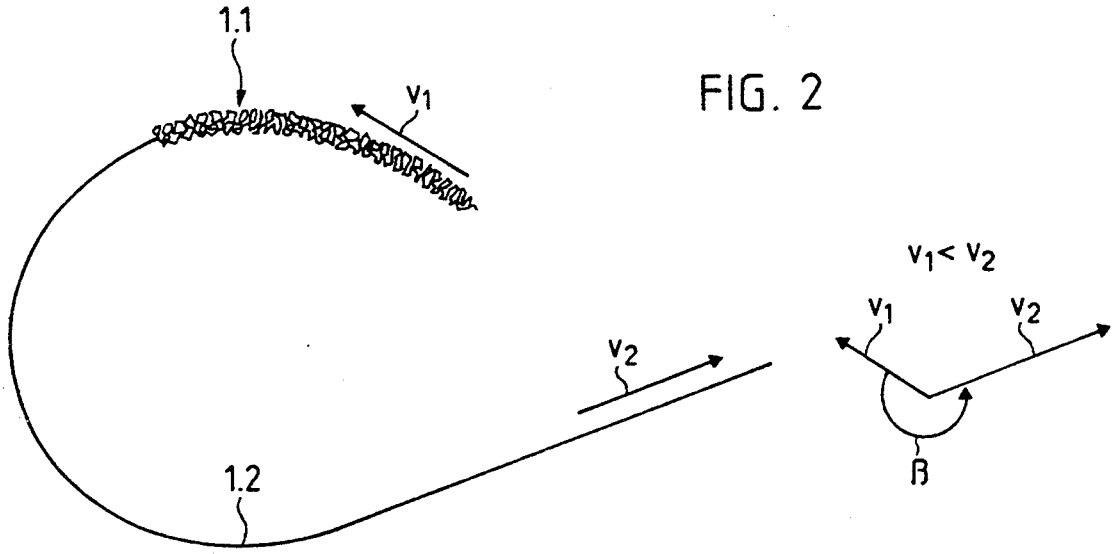

These and other objects and advantages of the invention will become more apparent from the following detailed description taken in conjunction with the accompanying drawings wherein:

FIG. 1 diagrammatically illustrates the physical basis for the forces acting during free deflection on a yarn;

FIG. 2 illustrates a general method diagram in accordance with the invention;

FIG. 3*a* illustrates an apparatus employing a cooling means and draw-off means in accordance with the invention;

FIG. 3*b* illustrates a modified embodiment similar to FIG. 3*a;*

Figure 4A:
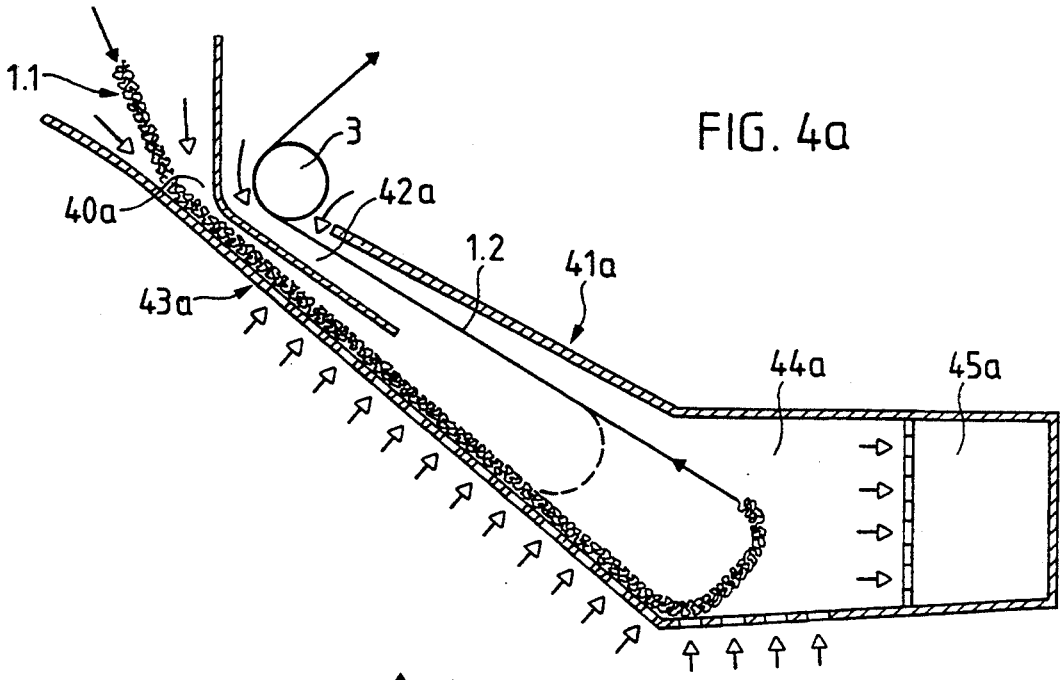
Figure 4B:
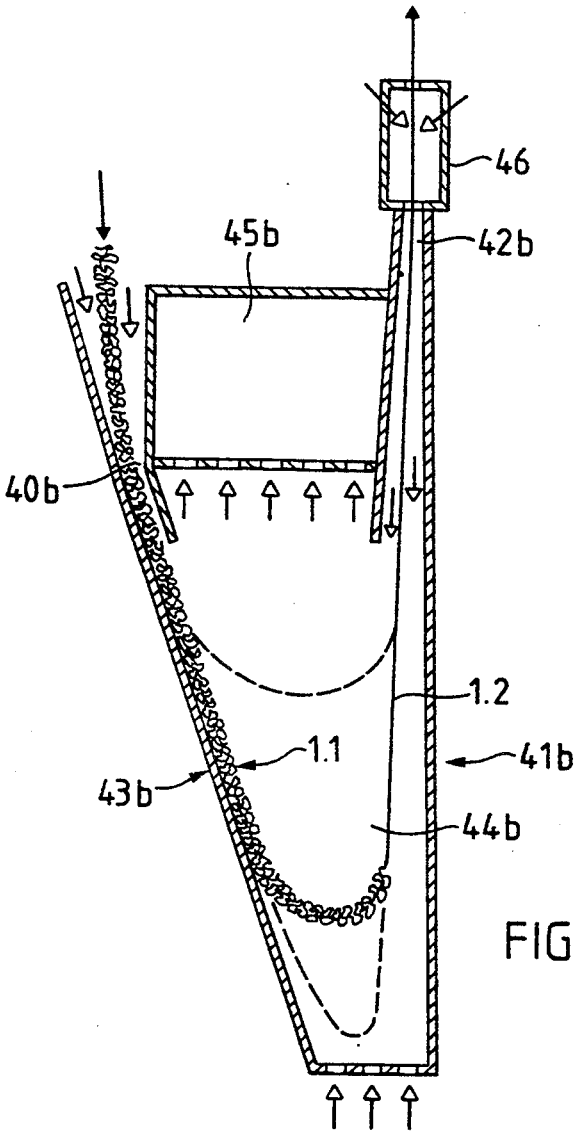
Figure 5A:
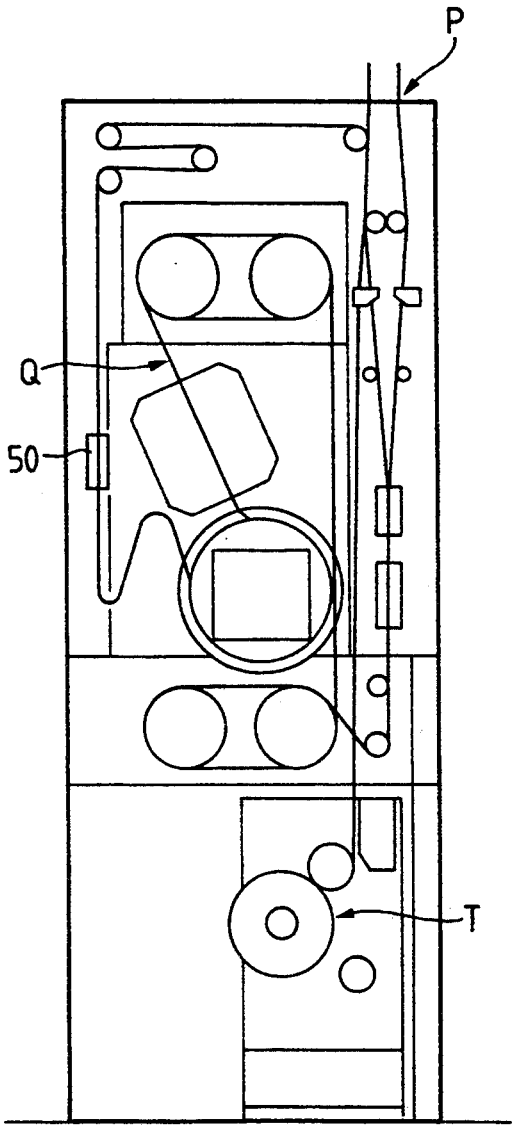
Figure 5B:
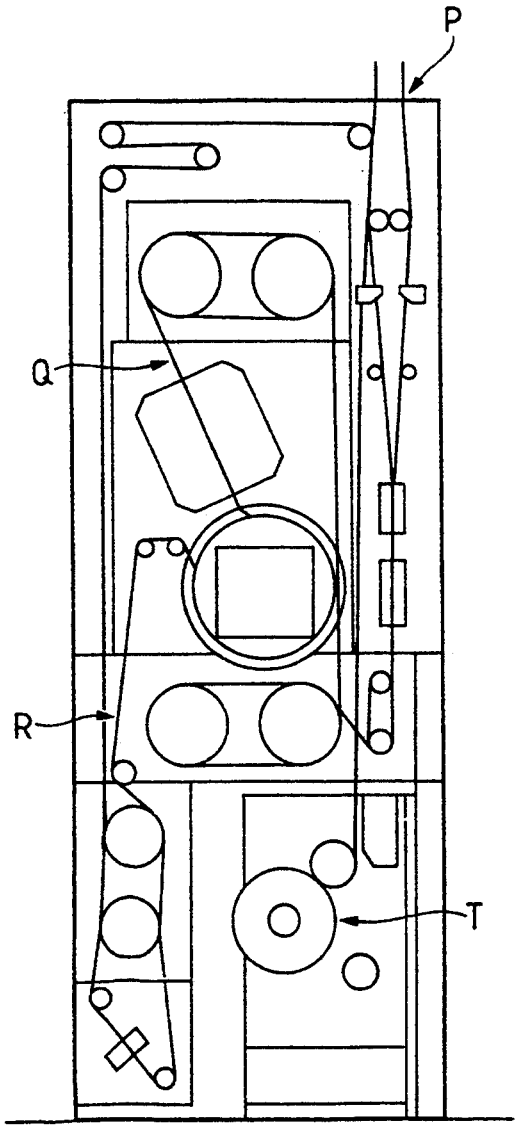

FIG. 4*a* illustrates a cross-sectional view of a ventilated housing employed in accordance with the invention;

FIG. 4*b* illustrates a cross-sectional view of a further modified ventilated housing employing a pneumatic disentangling nozzle in accordance with the invention;

FIG. 5*a* diagrammatically illustrates a side view of a yarn production system for texturing thermoplastic yarns in accordance with the invention; and FIG. 5*b* illustrates a view similar to FIG. 5*a* of a conventional yarn production system for plug loosening.

FIG. 1 illustrates the forces acting during a deflection or reversal of a yarn 1. In order that the yarn moves around a deflection or reversal radius r, for each yarn portion, e.g. that between points A and B with the mass m and the length l, a corresponding centripetal force Kz must be applied. This centripetal force can be broken down into tow force components Ksv and Ksr acting in and in opposition to the yarn movement direction and which act from the adjacent yarn portion to the considered yarn portion and tension the latter. It follows from the physical conditions for the centripetal force:

$$|Ksv| = |KsR| = (m/l) \times v^2$$

in which m/l stands for the mass of the yarn per length unit and v is the yarn speed.

If the forces Ksv and KSR are large enough to allow the yarn to become stiff, then without mechanical guidance elements, the deflection is stable. Such stable deflection means are known in connection with long strips or tapes, which are guided by dancers and which without further mechanical assistance can be moved over complicated paths and in a stable manner through the air. If the tensile forces are greater than the force necessary for loosening the plug or for stretching the yarn, the plug is loosened or the yarn is stretched.

It is clear from the equation that the tensile forces are not dependent on the deflection radius, but instead on the yarn thickness and yarn speed. In the case of a thinner yarn with a smaller m/l, for the same speed, lower forces act than in the case of a thicker yarn. The forces increase for the same yarn thickness with increased speed. If these forces are utilized for plug loosening and yarn stretching, these two facts act advantageously, because higher tensile forces for the same elastic characteristics of the yarn lead to greater stretching effects, i.e. a thicker irregular yarn is stretched more for the same deflection than a normally thick yarn and with increasing yarn speed between the end portion of the plug and the draw-off bobbin, the stretching forces successively increase.

FIG. 2 represents the inventive method in diagrammatic form. The yarn plug 1.1 is moved at constant speed v1 in the direction indicated by the arrow v1 and the yarn 1.2 is drawn off in a different direction with a constant speed v2, which is greater than v1. As a result of the direction change, a deflection or reversal is necessary, which is stable without mechanical guidance under the conditions given in connection with FIG. 1. The forces acting in this deflection on the plug 1.1 or yarn 1.2 also effect a loosening and stretching action i.e. a straightening action. The speeds v1 and v2 must be adjusted in such a way that the deflection is stable and that the forces which act are sufficient for loosening the plug and for stretching the yarn to the desired extent. The deflection radius will be set as a function of the chosen speeds, the available free yarn length and the arrangement of the equipment parts. Equilibrium is mainly dependent on the elastic and plastic characteristics of the plug 1.1 and the yarn 1.2, the two speeds v1 and v2 and the equipment caused deflection or reversing angle $\beta$. A specific curve shape of the plug - yarn loop will correspond to each equilibrium. In the state of equilibrium, the plug—yarn loop is so stable, as to require no mechanical link for supporting the loop.

The force acting in a decelerating manner on the yarn can be increased or decreased by any random forces additionally acting on the yarn in such a way that they can be broken down into components, so that one component acts in opposition to the yarn movement direction, i.e. as a braking power, or in the yarn movement direction, i.e. decreasing the braking action. For example, it is possible to use gravity or frictional force on a flowing or stationary medium.

Referring to FIG. 3*a,* an apparatus for straightening a textured thermoplastic yarn delivered from a texturing means 4, such as a texturing nozzle or a stuffing box includes a cooling means in the form of a screening drum or perforated roller 2 as well as a draw-off means in the form of a rotatable draw-off bobbin 3. As indicated, the screening drum 2 rotates at a constant surface speed v1 while air is drawn into the screening drum 2 in order to hold the yarn plug 1.1 on the drum surface while simultaneously cooling the yarn plug 1.1.

As the screening drum 2 rotates, the plug 1.1 is delivered to a point C on the drum 2 below the texturing means 4 and is carried along to a point D1 or D2 from where the yarn plug is released from the drum surface such that the yarn plug is no longer held on the drum by a vacuum force. In this respect, the screening drum 2 may be provided with any suitable means for releasing the textured plug from the drum at the variable points D1, D2 in order to vary the cooling angle of the plug on the drum. For example, the means may be in the form of a baffle plate positioned over the drum periphery or in the form of a sealing means fitted in the interior of the drum to selectively seal over the perforations in the drum at the point D1, D2.

The yarn 1.2 is drawn onto the draw-off bobbin 3 at a higher speed v2. Through the variation of the point D (D1 or D2), the cooling angle $\tau$ ($\tau 1$ or $\tau 2$) changes. Thus, in particular, the deflection angle $\beta(\beta 1$ or $\beta 2)$ changes, which has an effect on the braking action on the yarn and therefore on the yarn tension upstream of the draw-off bobbin. However, such a change also modifies the plug cooling time, which has the effect of modifying the elastic and plastic characteristics of the plug and the yarn. Thus, the cooling angle $\tau$ is suitable as a variation parameter for the stretching process. The cooling angle $\tau$ can be varied by displacing the baffle plate, which releases the plug from the drum, or by displacing a sealing means which is provided for closing the perforations within the drum.

As shown, the draw-off bobbin 3 is disposed below and is horizontally spaced from the drum 2 in order to effect a free unguided loop in the yarn extending therebetween. As indicated, depending upon the point at which the yarn plug is released from the drum 2, the loop may vary.

Referring to FIG. 3*b*, wherein like reference characters indicate like parts as above, the draw-off bobbin 3 may be disposed above and horizontally spaced from the drum 2 in order to permit the yarn plug, upon release from the drum 2, to move in an upward direction against gravity to a point E and thereafter to move in a downward direction with gravity to a point F before again moving upwardly to the bobbin 3. In this embodiment, gravity is increasingly incorporated into the braking process during the deflection or reversal. By a corresponding arrangement of the release point D3, the plug 1.1 can move upwards under its kinetic energy while changing direction at point E, which is dependent on the plug speed, the plug weight and the weight of the downwardly hanging plug portion. From the second point F, the yarn plug 1.1 is deflected upwards again by the draw-off bobbin 3 to move in a free unguided manner. As described above, the upward deflection has a braking action on the plug. In addition to the tensile forces caused by the deflection, gravity also has a braking effect at the deflection point F and increases the braking action, which leads to a higher yarn tension.

Variants of the two apparatuses shown in FIGS. 3*a* and 3*b* comprise fitting additional means with which e.g. air can be blown against the deflection point and namely from the concave side to increase the braking power and from the convex side to decrease the braking action. Advantageously, in these cases, a correspondingly shaped housing with corresponding air inlets and outlets can surround the deflection point.

FIGS. 4*a* and 4*b* show exemplified embodiments in which no use is made of rotary screening drums for cooling the yarn plug. In both cases, the plug 1.1 is conveyed through an inlet 40 into a channel-like, ventilated housing 41 in which, driven by gravity, the plug is moved downwards. The plug 1.1 is then deflected by the force and draw-off direction of the bobbin 3 and is drawn off in accelerated manner through an outlet 42 on the housing 41.

Referring to FIG. 4*a*, the ventilated housing 41*a* is disposed between a texturing nozzle (not shown) and the draw-off bobbin 3. This housing 41*a* has an inlet 40*a* for receiving a downwardly directed yarn plug 1.1 from the texturing nozzle as well as an outlet 42*a* for directing a stretched yarn 1.2 to the draw-off bobbin 3. As also shown, the housing 41*a* has an inclined guide channel 43*a* which extends from the inlet 40*a* and which has a plurality of perforations therein for blowing of air into the inlet 40*a* in the conveying direction of the yarn plug 1.1. In addition, the housing 41*a* has a horizontal perforated deflection chamber 44*a* communicating with the guide channel 43*a* in order to permit a change of direction of the yarn plug therein in a free unguided manner. As indicated, the horizontal deflection chamber 44*a* has a perforated bottom for the blowing in of air.

As indicated, the outlet 42*a* is disposed in parallel 2 and above the inlet 40*a*. Also, on the side opposite to the inlet 40*a* and outlet 42*a*, the housing 41*a* is provided with a spent air channel 45*a* which is connected to the deflection chamber 44*a* via a plurality of suitable openings. This spent air channel 44*a* serves to draw active air out of the housing 41*a* while external air is drawn through the perforations in the guide channel 43*a* and the bottom of the deflection chamber 44*a* as well as through the inlet 40*a* and outlet 42*a*. The resulting air flow in the housing 41*a* (as indicated by the arrows) is in the yarn conveying direction in the inlet 40*a* and counter thereto in the outlet 42*a*. Thus, the resulting air flow has a decelerating effect on the yarn 1.2. As a function of the position of the free unguided deflection loop, the air flow in the deflection chamber 44*a* has a varying decelerating action on the plug 1.1 and the yarn 1.2.

Referring to FIG. 4*b* which illustrates a similar apparatus to that of FIG. 4*a*, the housing 41*b* has a much steeper guide channel 43*b* so that the free unguided deflection loop assumes a hanging position. In this case, gravity has a decelerating effect but the spent air channel 45*b* is positioned between the inlet 40*b* and outlet 42*b* so that the airflow through the housing 41*b* opposes the decelerating effect.

As indicated, a pneumatic disentangling nozzle 46 is disposed above the outlet 42*b* of the ventilated housing 41*b* for directing an air flow against the yarn 1.2 passing therethrough in order to disentangle and stretch the yarn 1.2. This nozzle 46 also acts as a brake for disentangling and stretching the yarn. The air flow necessary in this nozzle 46 for deceleration purposes can also be guided in such a way that the force which the air flow exerts on the yarn does not act precisely in the direction opposed to the yarn movement direction and therefore, simultaneously with a yarn stretching brings about a whirling of the fibrils. This obviates any need for a separate whirling device.

FIG. 5 shows how any random one of the above embodiments of the apparatus can be integrated for plug loosening in a complete textured yarn production system. The system is shown in FIG. 5*a*, whilst FIG. 5*b* shows a corresponding prior art system and is used for comparison purposes. The system comprises an entry zone between points P and Q, in which the fibrils passing out of spinnerets are combined to form a yarn and the latter is prestretched. Between points Q and R there is the texturing zone in which the yarn is textured and the plug formed during texturing is loosened. This is followed between points R and T by the draw-off zone in which the yarn is stretched, whirled up and wound up. In FIG. 5*a*, point R between the texturing zone and the draw-off zone is not shown, because through the use of a pneumatic disentangling and simultaneously whirling nozzle 50 the two zones merge. It is clear from the comparison of FIGS. 5*a* and 5*b* that the use of the inventive plug loosening apparatus together with the combined, pneumatic nozzle greatly simplifies the system.

Various modifications may be made of the above embodiments. For example, a ventilated housing such as the ventilated housing 41*a* of FIG. 4*a* may be positioned between a cooling means and the draw-off bobbin.

The invention thus provides a relatively simple technique for the production of a desired yarn tension in a textured yarn without the need for mechanical friction on the textured yarn.

The invention further provides a method and apparatus for winding up a textured yarn with intact fibrils.

What is claimed is:

1. In a method of producing a textured thermoplastic yarn the steps of forming a textured yarn plug in a texturing means;

moving the textured yarn plug in a first direction at a first speed; and thereafter forming a free unguided loop of said yarn plug while changing the direction of movement of the yarn plug into a second direction and simultaneously increasing the speed of the yarn plug to a second speed sufficient to straighten the yarn plug.

2. A method as set forth in claim 1 wherein the yarn plug is moved at said first speed to a predetermined point and is thereafter moved from said point at said second speed.

3. A method as set forth in claim 1 wherein said first direction has a downwardly directed vertical component and said second direction has an upwardly directed vertical component.

4. A method as set forth in claim 1 further comprising the step of cooling the yarn plug as the yarn plug moves in said first direction.

5. An apparatus for texturing a thermoplastic yarn comprising a texturising means for texturing a moving thermoplastic yarn into a textured yarn plug;

a cooling means for cooling the yarn plug extending from said texturizing means and releasing the yarn plug therefrom with the yarn plug moving in a first direction and at a first speed; and a draw-off means for drawing-off the yarn plug from said cooling means to pull the yarn plug into a straightened yarn, said draw-off means being disposed relative to said cooling means to form a free unguided loop of one of the yarn plug and yarn while changing the direction of movement of one of the yarn plug and yarn to a second direction in a free unguided manner while increasing the speed of the yarn to a second speed sufficient to straighten the yarn plug therebetween.

6. The combination as set forth in claim 5 wherein said cooling means includes a perforated drum disposed below said texturing means for receiving and holding the textured plug on a periphery thereof under a suction force existing over a predetermined angle of said periphery and means for creating a suction force within said drum over said predetermined angle of said periphery.

7. The combination as set forth in claim 6 which further comprises means for releasing the textured plug from said drum at a variable point on said periphery of said drum to vary a cooling angle of the plug on said drum.

8. The combination as set forth in claim 6 wherein said means for releasing the plug is a baffle plate positioned over said drum periphery.

9. The combination as set forth in claim 6 wherein said means for releasing the plug is a sealing means fitted in an interior of said drum to selectively seal over perforations in said drum at said point.

10. The combination as set forth in claim 6 wherein said draw-off means is a rotatable bobbin disposed below and horizontally spaced from drum to form a free loop in one of the yarn plug and yarn extending therebetween.

11. The combination as set forth in claim 6 wherein said draw-off means is a rotatable bobbin disposed above and horizontally spaced from said drum to permit a yarn plug released from said drum to move in a free and upward direction against gravity and to thereafter freely turn and move in a downward direction before again moving upwardly to said bobbin.

12. The combination as set forth in claim 5 wherein said cooling means comprises a ventilated housing having an inlet for receiving a downwardly directed yarn plug from said texturing means and an outlet for directing a straightened yarn to said draw-off means.

13. The combination as set forth in claim 12 wherein said housing has an inclined guide channel extending from said inlet and having perforations therein for blowing of air into said inlet in the conveying direction of the yarn plug and a horizontal perforated deflection chamber extending from and communicating with said guide channel to permit a change of direction of the yarn plug therein.

14. The combination as set forth in claim 13 wherein said outlet is disposed in parallel to and above said inlet.

15. The combination as set forth in claim 12 which further comprises a pneumatic disentangling nozzle above said outlet of said ventilated housing for directing an air flow against the yarn passing therethrough to disentangle and stretch the yarn.

16. A method as set forth in claim 1 wherein at least one of said first direction and said second direction is vertically disposed to permit gravity to act on the yarn plug.

17. An apparatus for texturing a thermoplastic yarn comprising a texturing means for texturing a moving thermoplastic yarn into a textured yarn plug;

a ventilated housing for passage of air therethrough, said housing having an inlet for receiving a downwardly directed yarn plug from said texturing means with the yarn plug moving freely in a first direction and at a first speed and an outlet for passage of a yarn from the yarn plug in a direction different from said first direction; and a draw-off means for pulling the yarn from said outlet of said housing to pull the yarn plug into a straightened yarn, said draw-off means being operable to increase the speed of the yarn to a second speed sufficient to straighten the yarn extending from the yarn plug wherein the yarn plug forms a free unguided loop in said housing.

18. The combination as set forth in claim 17 wherein said housing has an inclined guide channel extending from said inlet and having perforations therein for blowing of air into said inlet in the conveying direction of the yarn plug and a horizontal perforated deflection chamber communicating with said guide channel to permit a change of direction of the yarn plug therein.

19. The combination as set forth in claim 18 wherein said outlet is disposed in parallel to and above said inlet.

20. The combination as set forth in claim 17 which further comprises a pneumatic disentangling nozzle above said outlet of said ventilated housing for directing an air flow against the yarn passing therethrough to disentangle the yarn.

21. An apparatus for texturing a thermoplastic yarn comprising a texturising means for texturing a moving thermoplastic yarn into a textured yarn plug;

cooling means for cooling the yarn plug extending from said texturing means with the yarn moving in a first direction and at a first speed;

means for releasing the textured yarn plug at variable positions from said cooling means; and a draw-off means for drawing off the yarn plug from said cooling means, said draw-off means being horizontally spaced from said cooling means and being operable to increase the speed of the yarn thereat to a second speed sufficient to straighten the yarn plug between said cooling means and said draw-off means while allowing the direction of movement of one of the yarn plug and yarn to change to a second direction in a free unguided manner.

* * * * *